US005121853A

United States Patent [19]

Edelhoff

[11] Patent Number: 5,121,853

[45] Date of Patent: Jun. 16, 1992

[54] GARBAGE CONTAINER

[75] Inventor: Gustav Edelhoff, Iserlohn, Fed. Rep. of Germany

[73] Assignee: Waste Management of North America, Oak Brook, Ill.

[21] Appl. No.: 737,711

[22] Filed: Jul. 30, 1991

[51] Int. Cl.[5] ..... B65D 6/34

[52] U.S. Cl. ..... 220/500; 220/908; 364/424.05

[58] Field of Search ..... 220/500, 908; 364/424.05

[56] References Cited

U.S. PATENT DOCUMENTS 4,712,701 12/1987 Durkan, Jr. ..... 220/908
4,722,270 2/1988 Wall ..... 220/908
4,917,257 4/1990 Edelhoff ..... 220/908
4,978,271 12/1990 Seader ..... 220/908

*Primary Examiner*—Joseph Man-Fu Moy
*Attorney, Agent, or Firm*—Allegretti & Witcoff, Ltd.

[57] ABSTRACT

The present invention refers to a garbage container with a pocket-like receiving means provided in the front section of the opening edge, for a gripping claw of a lifting/tilting apparatus. In order to guarantee a perfect data transfer between a data carrier provided at the garbage container and an identification system provided at the lifting means, according to the invention in a recess of the pocket-like receiving means a fixing means wtih a data carrier is arranged.

4 Claims, 2 Drawing Sheets

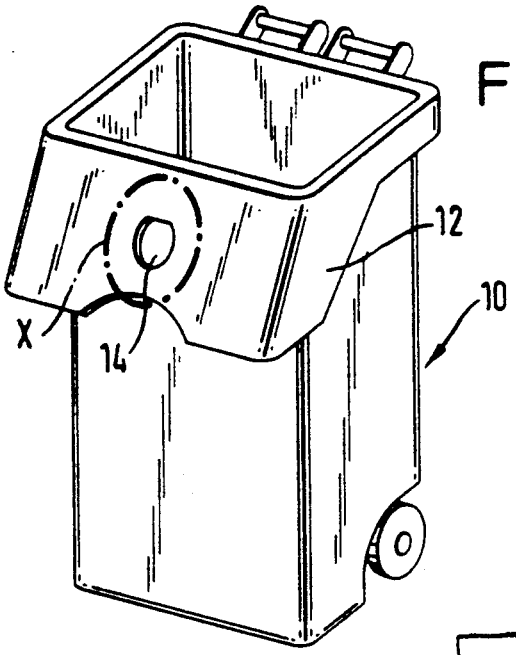
Fig. 1
Fig. 2
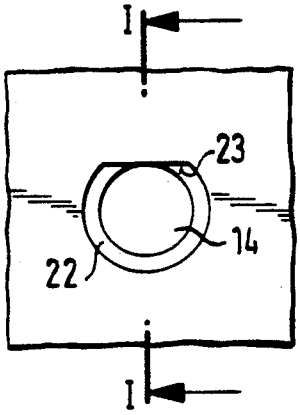
Fig. 3
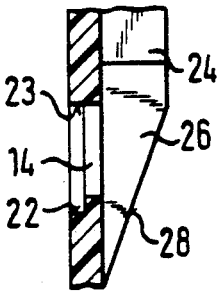
Fig. 4
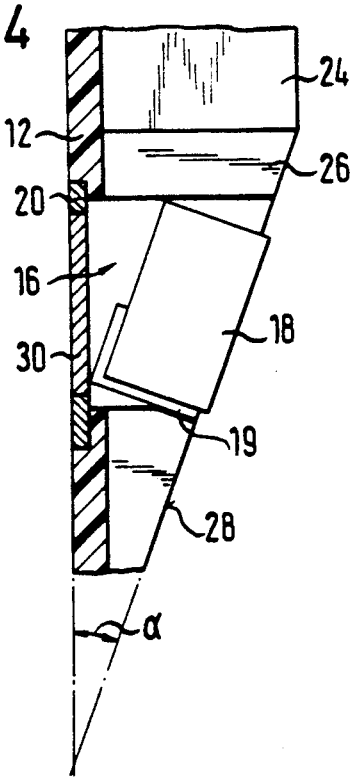
Fig. 5
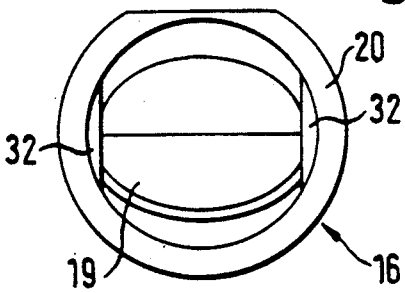

GARBAGE CONTAINER

BACKGROUND OF THE INVENTION

1. Field of the Invention

The present invention refers to a garbage container with a pocket-like receiving means, provided in the front section of the opening edge, for a gripping claw of a lifting/tilting apparatus.

2. Description of Prior Art

Garbage containers of said kind are already known e.g. from the European Patent Application EP 288 066 A2. Already therein, a receiving pocket is provided in the upper front section of the container body. Within the receiving pocket there are arranged perpendicularly extending ribs spaced apart from each other. The lower edges of said ribs show as form which corresponds to the one of the effective area of a triangular gripping claw the tip of which points upwardly and which has a lower horizontal edge. Therefrom, the garbage container which usually is made of plastic by injection molding, receives its required rigidity and fatigue strength with respect to work resulting from the picking up and the tilting by the gripping claw of a lifting-/tilting apparatus.

With respect to the waste disposal for which e.g. the above-described garbage containers are used, at present there is carried out a recording of costs for the waste disposal service of different materials, either according to the capacity of $m^3$ of the provided container or according to a flat rate. However, the actually arising amounts of trash are only inadequately taken into account so that the current calculation of costs is unfair. In order to be able to carry out a calculation of costs according to the pay-as-you-produce-waste principle, occasionally automatic identification systems have been developed. In order to be able to determine the disposal fees individually, the weight of the individual garbage fractions is weighed as the most important parameter for the individual determination of the fees. For this purpose, the garbage containers are weighed prior to discharging. Automatic garbage container identification systems have already been proposed for being able to attribute the arising trash to the respective producer. For this purpose, at the garbage containers data carriers are arranged in which for instance the customer number, the kind of fraction, the size of the container and the total sum of the already discharged weight can be stored. During discharging, said information are ready by an identification system arranged at the lifting means of the lifting/tilting apparatus of the garbage truck and transferred via a data bus to a central unit of a microcomputer. Prior to emptying, the precisely identified garbage container is weighed by means of a weighing system integrated into the lifting means. These data are also passed on to the central unit and simultaneously stored in the data carrier by means of a write head also integrated into the lifting means. During the data transfer from the data carrier at the garbage container to the read head arranged at the lifting means and vice versa, a perfect allocation from the data carrier to the write-read head of the identification system is necessary.

SUMMARY OF THE INVENTION

The present invention is based on the problem to further develop a garbage container of the generic type such that the information stored in the data carrier of the garbage container can be easily read by means of a read head and supplemented by means of a write head.

According to the invention said problem is solved in that the recess of the pocket-like receiving means a fixing means with a data carrier arranged therein is put. Said arrangement has the advantage that the data carrier can be positioned in a particularly easy manner and exactly with regard to position in the pocket-like receiving means so that it lies in the correct position to a write-read head being e.g. arranged in the gripping claw or in the holding bar.

According to an advantageous development, at the fixing means for the data carrier an edge is formed which, in the mounted state, lies in a groove surrounding the recess in the pocket-like receiving means.

The fixing means with the integrated data carrier preferably protrudes into the interior of the pocket-like receiving means.

Within the receiving pocket the perpendicularly extending, spaced apart ribs, which are attached for reinforcing, are arranged in such a manner that their edges pointing to the bottom are bevelled such that they copy the contour of the effective area of the receiving part. The plate-shaped data carrier is received in the free end of the fixing means such that it is bevelled at the same angle as the edges of the reinforcing ribs. Then, after engaging of the gripping claw, the plate-shaped data carrier lies parallel to the surface of the gripping claw, wherein the write-read head of the identification system is arranged in an advantageous manner. By said arrangement, a correspondence, exact with regard to position, between the data carrier and the identification system at the lifting means is ensured.

The fixing means can be closed from the outside with a round plate made of plastic so that it is protected against environmental influences.

Embodiments of the invention will now be described in the following with reference to the drawing.

BRIEF DESCRIPTION OF THE DRAWING

FIG. 1 is a perspective view diagonally from above onto a partly dismounted garbage container according to the present invention.

FIG. 2 shows a detail corresponding to sector X in FIG. 1 in a top view.

FIG. 3 is a sectional view along the line I—I in FIG. 2.

FIG. 4 is a sectional view similar to FIG. 3 with installed fixing means.

FIG. 5 is a top view onto the fixing means prior to installation in the garbage container according to the invention.

DETAILED DESCRIPTION OF PREFERRED EMBODIMENTS

Figure 6:
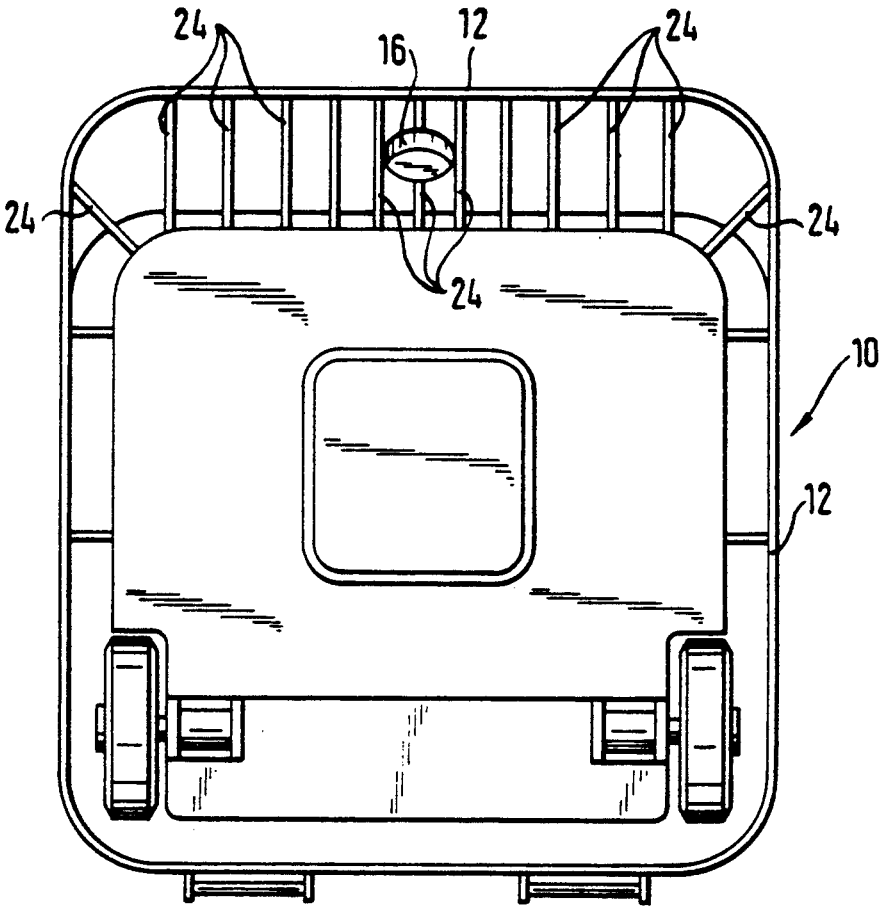
FIG. 6 is a bottom view of the garbage container according to the invention.

FIG. 1 shows a garbage container 10 as already described in detail in the European Patent Application EP 288 066 A2. With regard to the details not repeated in the following it is referred to the disclosure therein.

The garbage container represented in FIG. 1 consists of a thermoplastic synthetic material and has a capacity of 120 liters in the described embodiment. In the front section of the container body there is provided a receiving pocket which, as a whole, has the reference numeral 12. Within the receiving pocket 12 there are arranged perpendicularly extending, spaced apart ribs which are not shown in FIG. 1, but which can be seen in the bottom view according to FIG. 6 and therein have the reference numeral 24. The lower edges of said ribs copy (not shown) the contour of the effective area of a gripping claw (also not shown) of a lifting/tilting apparatus. Said gripping claw is a triangular pick-up claw the tip of which points upwardly and which has a lower horizontal edge. Due to the design of the ribs an exactly fitting engagement of the gripping claw and a self-centering thereof is ensured during picking up the garbage container.

At the front side of the receiving pocket 12, approximately at the center thereof, there is arranged a circular recess 14 for the reception of a fixing means for a data carrier. In FIGS. 2 and 3 there can be seen that the edge of the recess 14 a groove 22 is set back which is used for the reception of an edge of the fixing means. The otherwise circular groove 22 is unilaterally flattened so that thereby a centering of the insertable fixing means is permitted. Said centering flattening is designated by 23.

In the sectional view according to FIG. 4 the fixing means 16 is put in the pocket-like receiving means 12. The edge 20 engages therein the groove 22 so that the fixing means, on the one hand, has a perfect fit and, on the other hand, does not protrude out over the surface of the pocket-like receiving means 12. Within the fixing means the data carrier 18 which consists of a plate-shaped passive microchip is held in an exact position in a fit 12. Therein, the data carrier 18 is bevelled with respect to the wall of the pocket-like receiving means 12 by an angle $\alpha$. Said angle corresponds to the angle $\alpha$ of the bevelled edge 28 of the ribs 26. As is shown in FIG. 4, the edges 28 extend parallel to the cover surface of the data carrier 18. Above the fixing means 16 a reinforcing rib 24 ends.

The arrangement of the ribs in relation to the fixing means 16 becomes easily obvious from FIG. 6.

The fixing means 16 which is shown in FIG. 5 without a data carrier 18 being put therein, advantageously consists of a plastic injection molded part. Normally, said fixing means is integrally connected with the pocket-like receiving means 12 so that the data carrier cannot be exchanged by unauthorized persons.

To the outside, the fixing means 16 represented in FIG. 5 is closed by a cover 30 (see FIG. 4). Said cover lies upon two shoulders 32 of the fixing means and fits to the edge 20.

What I claim is:

1. A garbage container having an opening edge, said opening edge having a front section which has attached a pocket-like receiver fabricated to engage a gripping claw of a lifting/tilting apparatus, said pocket-like receiver having an outside surface containing a recessed portion, said recessed portion containing means for fixing a data carrier, whereby said fixing means is positioned such that the data carrier can exchange stored information with the lifting/tilting apparatus.

2. The garbage container of claim 1, wherein the fixing means has an edge formed to fit into a groove in the recessed portion of the pocket-like receiver.

3. The garbage container of claims 1 or 2, wherein the fixing means contains a transparent plate flush with the outside surface of the pocket-like receiving which encloses and protects the data carrier from the outside environment.

4. The garbage container of claim 3, wherein the transparent plate is round and fabricated of a plastic material.

* * * * *